United States Patent [19]

Alquier et al.

[11] 4,377,937

[45] Mar. 29, 1983

[54] METHOD AND APPARATUS FOR EXTRACTING HEAT FROM A POWDERED WATER-ABSORBANT SUBSTANCE AT LESS THAN 100° C.

[75] Inventors: Serge Alquier, Seyssinet Parisel; Louis Berthod, Grenoble, both of France

[73] Assignee: Alsthom-Atlantique, Paris, France

[21] Appl. No.: 299,251

[22] Filed: Sep. 3, 1981

[30] Foreign Application Priority Data

Sep. 4, 1980 [FR] France ..... 80 19093

[51] Int. Cl.[3] ..... F25D 17/02

[52] U.S. Cl. ..... 62/374; 34/104; 239/102

[58] Field of Search ..... 62/63, 374, 64; 34/164; 239/102

[56] References Cited

U.S. PATENT DOCUMENTS

| | | | |
|---|---|---|---|
| 1,844,782 | 2/1932 | Mittag | 62/374 |
| 2,863,190 | 12/1958 | Buhrer | 22/89 |
| 3,089,653 | 5/1983 | Ostberg | 34/164 |
| 3,161,485 | 12/1964 | Buhrer | 34/236 |
| 3,172,177 | 3/1965 | Brauchla | 22/217 |
| 3,205,543 | 9/1965 | Morris et al. | 22/89 |
| 3,412,477 | 11/1968 | Kayatz | 34/164 |

FOREIGN PATENT DOCUMENTS

| | | |
|---|---|---|
| 942271 | 3/1956 | Fed. Rep. of Germany . |
| 2540124 | 4/1976 | Fed. Rep. of Germany . |

*Primary Examiner*—Ronald C. Capossela
*Attorney, Agent, or Firm*—Sughrue, Mion, Zinn, Macpeak & Seas

[57] ABSTRACT

Spray nozzles (16, 18, 20) inject just sufficient water to produce the desired cooling of hot powdered substance by evaporation of the water. The water is sprayed finely and uniformly onto said substance to avoid wet lumps agglomerating. The substance comes from a hopper (2), and flows through the apparatus in the opposite direction to a drying gas flow from inlet (21) to a condenser (22) where the heat is recovered from the water vapor.

Application to recycling foundry sand and, more generably, to using sand which has been heated.

1 Claim, 1 Drawing Figure

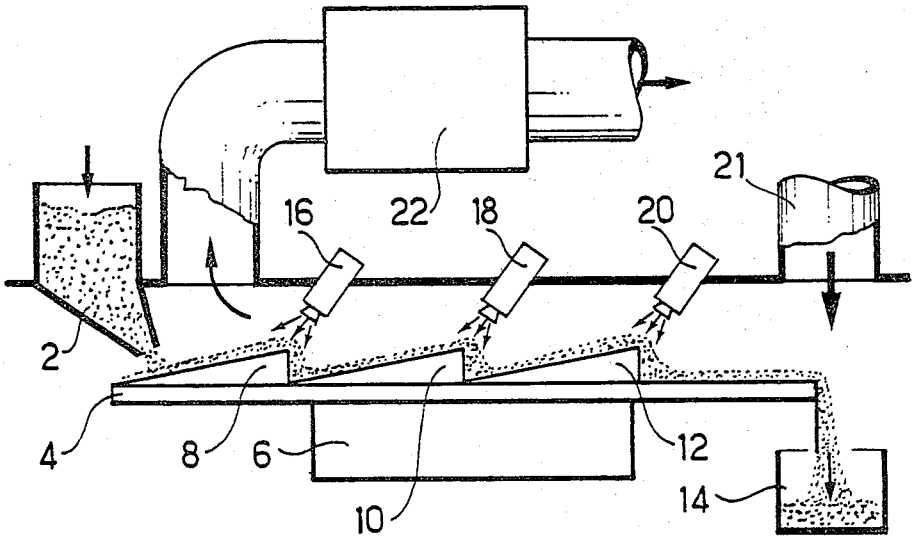
21
16
22
18
20
2
4
8
6
12
10
14

METHOD AND APPARATUS FOR EXTRACTING HEAT FROM A POWDERED WATER-ABSORBANT SUBSTANCE AT LESS THAN 100° C.

The invention relates to apparatus for extracting heat from a powdered water-absorbent substance at less than 100° C.

Such a substance is, for example, foundry sand which has just been used and which has been cooled to 100° C. by vaporizing water, or alternatively sand which has been flame dried and is still at a temperature of 100° C. To continue handling this substance, it is desirable to begin by cooling it from 100° C. to 40° C. while avoiding residual dampness as far as possible.

BACKGROUND OF THE INVENTION

It is known that very hot sand can be cooled to about 100° C. by spraying it with water. As for cooling below 100° C., this is conventionally done without spraying water in order to obtain very dry sand.

For example, to cool foundry sand from 100° C. to 40° C. and recover the heat, several known methods can be used in which the cooling fluid is either:

atmospheric air in direct contact with the sand; or water in indirect contact via the walls of a heat exchanger.

In both these cases, the heat transfer coefficients are fairly low, typically a few tens of kcal/h.m$^2$.° C., whereas the heat transfer coefficients by direct evaporation and direct condensation of water are about 1000 kcal/h.m$^2$.° C.

It would therefore be advantageous to use water as the cooling fluid. However, when the sand to be cooled is sand which has been dried in a rotating furnace, it is pointless to cool it to 40° C. by a process which wets it. The cooled sand must be perfectly dry for use in a foundry mould or for transport. Further, it is often useful to recover heat from the sand as it is cooled.

Preferred embodiments of the present invention provide apparatus for extracting heat from a water-absorbant powdered substance at temperatures below 100° C. The apparatus makes it possible to obtain cooled dry substance and to recover the heat extracted.

SUMMARY OF THE INVENTION

The present invention provides apparatus for extracting heat from a powdered water-absorbant substance at a temperature below 100° C., wherein the apparatus comprises means for setting the substance into turbulent motion, means for spraying water onto the surface of said substance in turbulent motion in just the necessary quantity for the required extraction of heat by subsequent evaporation of the water deposited on grains of the powdered substance, and means for making a gas flow in contact with the substance in turbulent motion so that the water deposited on the grains evaporates before coming sufficiently into contact with neighbouring grains to cause the grains to agglomerate, said gas ensuring the removal of the water vapour thus produced.

Preferably the means for setting the powdered substance into turbulent motion include a shaker conveyor, said conveyor having a succession of ramps, the shaking of the conveyor being chosen so as to make the grains rise up each ramp in succession and then fall each time they reach the top of a ramp, the means for spraying the water being disposed in the neighbourhood of the zones where the grains fall from the top of a ramp.

Said apparatus implements the following method:

the substance to be cooled is set into turbulent motion;

water is sprayed onto this substance in turbulent motion in just the necessary quantity for the required extraction of heat by subsequent evaporation of water deposited on the grains; and a gas is made to flow in contact with the substance in motion so as to evaporate the deposited water.

Advantageously, this method includes the following operations:

the water is sprayed so that at least 90% of the droplets formed have a diameter of less than 70% of the diameter of at least 90% of the grains of the powdered substance.

When the powdered substance has substantially uniform grain diameter, the water is sprayed so that the droplets formed have diameters lying substantially between 60% and 30% of the average diameter of the grains of substance.

BRIEF DESCRIPTION OF THE DRAWING

A preferred embodiment of apparatus in accordance with the invention is described hereinbelow by way of non-limiting example with reference to the sole FIGURE of the accompanying drawing, which FIGURE is a partially cutaway diagrammatic side view of the apparatus.

DESCRIPTION OF PREFERRED EMBODIMENT

Before describing the apparatus, a few explanations will be given relative to the method which it implements. The description concerns cooling sand.

The exact quantity of water necessary for the desired cooling is uniformly sprayed onto the surface of the sand. Said quantity is calculated on the basis of about 550 calories being removed per kg. of water evaporated.

Water evaporation is assisted by a small flow of gas, possibly under low pressure, which reduces the partial water vapour pressure on each grain and thus allows evaporation before the grains are able to agglomerate. Further, the gas flow entrains and thus removes the water vapour produced. It is necessary to spray water uniformly on the surface of the sand and it turns out that the weight of cold water to be injected is only about 3% of the weight of the sand to be cooled.

Commercially available spray nozzles produce drops which are large relative to the grain size of the sand, e.g. 200μ drops for sand with an average grain size of 130μ (i.e. lying between 40μ and 200μ), so that the said 3% by weight of water tends to form little beads of damp sand which must be dispersed by mechanical means (rotating drum, shaker, etc.).

It is preferable to dampen the sand as uniformly as possible with only 3% by weight of water. To do this, it is possible to use "ultrasonic" type nozzles which produce a "mist" of very fine particles, e.g. 20μ in diameter. A given weight of water produces 1000 times more drops at 20μ diameter than it does drops at 200μ diameter. Thus, the sand is dampened much more uniformly and therefore it will cool by evaporation more rapidly and more uniformly.

The apparatus illustrated in the FIGURE comprises a hopper 2 for feeding powdered material, e.g. hot foundry-sand, which falls on a shaker conveyor whose table 4 is set in motion by a mechanism 6 of known type. Three rising ramps 8, 10 and 12 are disposed on the table 4 and the sand rises successively along them under the action of the shaking caused by the mechanism 6.

At the top of each ramp, the sand falls to the bottom of the following ramp to be finally brought to an outlet receptacle 14.

Water spray nozzles 16, 18 and 20 respectively are disposed near the top of each ramp and spray water onto the sand at those zones where layers of sand are mixed and where the sand drops, i.e. near the tops of the ramps.

Of course, the shaker conveyor may be horizontal, inclined or helical. The gas which, as stated hereinabove, provides for evaporation is preferably air and is sent via a pipe 21 preferably in the opposite direction to that of the sand and meets each grain which falls from the ramps, thus ensuring evaporation of the water and entraining the water vapour produced. The air recovered in the neighbourhood of the hopper 2 is then hot and damp. It is sent into a condenser 22 where the heat is recovered.

We claim:

1. Apparatus for extracting heat from a powdered water-absorbent substance at a temperature below 100° C., said apparatus comprising: means for setting the substance into turbulent motion, means for spray water in droplets having a diamete of 20$\mu$ and a flow rate of about 3% by weight to the weight of the substance in turbulent motion constituting the necessary quantity for the required extraction of heat by subsequent evaporation of the water deposited on the grain of the powdered substance, and means for causing a gas flow in contact with the substance while in turbulent motion so that the water deposited on the grains evaporates before coming sufficient into contact with neighboring grains to cause the grains to agglomerate, said gas ensuring the removal of the water vapour thus produced, means for setting the powdered substance into turbulent motion includes a shaker conveyor, said conveyor having a succession of inclined ramps, and means for driving the shaker conveyor under conditions where the grains rise up each inclined ramp in succession and then fall each time they reach the top of a ramp and wherein the means for spraying the water is disposed in the neighborhood of the zones where the grains fall from the top of a ramp, and wherein the spray nozzles face the top of the ramp.

* * * * *